US005905513A

United States Patent [19]

Brandon et al.

[11] Patent Number: 5,905,513

[45] **Date of Patent: *May 18, 1999**

[54] INK JET PRINTHEAD BODY HAVING WIPER CLEANING ZONES LOCATED ON BOTH SIDES OF PRINTHEAD

[75] Inventors: Fred Young Brandon; Bruce David Gibson; Edmund Hulin James, III; Michael David Lattuca, all of Lexington, Ky.

[73] Assignee: Lexmark International, Inc., Lexington, Ky.

[ * ] Notice: This patent issued on a continued prosecution application filed under 37 CFR 1.53(d), and is subject to the twenty year patent term provisions of 35 U.S.C. 154(a)(2).

[21] Appl. No.: 08/546,259

[22] Filed: Oct. 20, 1995

[51] Int. Cl.[6] ..... B41J 2/165; B41J 35/00

[52] U.S. Cl. ..... 347/33; 400/701

[58] Field of Search ..... 347/33, 22; 400/701; 15/256.5, 97.1, 88.1; 342/22, 33

[56] References Cited

U.S. PATENT DOCUMENTS

| | | | |
|---|---|---|---|
| 5,115,250 | 5/1992 | Harmon et al. | 347/33 |
| 5,202,702 | 4/1993 | Terasawa et al. | 347/32 |
| 5,374,948 | 12/1994 | Saito et al. | 347/47 |
| 5,389,957 | 2/1995 | Kimura et al. | 347/20 |
| 5,536,312 | 7/1996 | Madrzak et al. | 15/256.5 |

FOREIGN PATENT DOCUMENTS

| | | | |
|---|---|---|---|
| 0 494 693 A1 | 7/1992 | European Pat. Off. | B41J 2/165 |
| 0 581 553 A2 | 2/1994 | European Pat. Off. | B41J 2/165 |
| 0 631 869 A1 | 1/1995 | European Pat. Off. | B41J 2/135 |
| 4-37556 | 2/1992 | Japan | B41J 2/165 |
| 6-115065 | 4/1994 | Japan | 347/22 |
| 6-210859 | 4/1994 | Japan | 347/22 |

*Primary Examiner*—N. Le
*Assistant Examiner*—Thien Tran
*Attorney, Agent, or Firm*—John J. McArdle

[57] ABSTRACT

An ink jet printhead body includes one or more zones for cleaning, guiding and stabilizing a printhead wiper of an ink jet printer. The printhead body includes a receptacle providing a reservoir for ink, and the receptacle includes a wall having an outer surface. The wall includes a region at which location of one or more ink discharge nozzles is established. A plurality of ribs is located in each of the wiper cleaning zones, which in turn is located to be adjacent the wall region. The orientation of the ribs may be defined with reference to a first axis extending in the plane of the outer wall surface and intersecting the wall region in a first direction, and by a second axis, or axis of symmetry, extending in the plane of the outer wall surface and extending substantially parallel to an edge of the wall and through a central portion of the region to perpendicularly intersect the first axis. The orientation of the plurality of ribs is such that a direction of elongation of at least some of the plurality of ribs is in a direction substantially non-orthogonal to both the first axis and the second axis. The plurality of ribs defines a plurality of non-rectangular cavities. The plurality of ribs and plurality of cavities cooperate to remove and collect excess ink and contaminants from the printhead wiper.

21 Claims, 4 Drawing Sheets

INK JET PRINTHEAD BODY HAVING WIPER CLEANING ZONES LOCATED ON BOTH SIDES OF PRINTHEAD

FIELD OF THE INVENTION

The present invention relates to ink jet printers for multicolor or monochrome printing. More particularly, the present invention relates to a novel printhead body including means for removing excess ink and contaminants from a printhead wiper.

BACKGROUND OF THE INVENTION

In an ink jet printer, there is a tendency during printing for ink to mix with dust and paper fibers and dry on the printhead surface surrounding the nozzles, thus interfering with ejection of ink from the nozzles. This problem may be at least partially solved by providing a wiper which extends into the path of travel of the printhead which wipes ink from the printhead surface surrounding the nozzles as the printhead is moved back and forth relative to the wiper.

The wiper may be disposed in a maintenance or service station located to one side of the record feed path. In some cases, the wiper is fixedly mounted at a height such that it extends through the plane of the feed path. In other cases, mechanisms are provided for moving the wiper into an operative position.

In some printhead maintenance mechanisms used in ink jet printers, either each color of the printhead has a separate maintenance assembly or, if all of the colors are housed in one printhead and the monochrome (usually black) housed in another printhead, the two printheads each have a separate maintenance assembly. This is typically the case regardless of whether the color printhead and the black printhead reside in the printer at the same time or if the two printheads are interchangeably mounted on a single printhead carrier.

Some efforts have been made to clean the wiper of removed excess ink and contaminants, so that the wiper can remain effective in cleaning the surface surrounding the nozzles. Such efforts, such as that disclosed in U.S. Pat. No. 5,202,702, are typically directed at providing a protrusion, or raised portion, of the head holder or printhead body which then engages the wiper blade to clean the surface of the wiper. Such protrusions extend substantially perpendicular to the direction of wiping.

Other efforts directed to cleaning a printhead wiper include providing a wiper well, or cavity adjacent to the area surrounding the printhead nozzles so as to remove and collect the excess ink and contaminants that have accumulated on the wiper. This design, however, contributes to increasing the decibel level of the noise generated during a wiper cleaning operation due to the wiper abruptly contacting, or "slapping", the sidewall of the cavity as the wiper enters the cavity. This "slapping" action also creates the risk of inadvertently throwing the removed excess ink and contaminants onto the print media.

In attempting to avoid the above-identified problems, ribs arranged parallel to the wiping direction have been incorporated to bridge across the cavity thereby preventing the wiper from fully entering into the cavity, and abruptly contacting a cavity sidewall. Such a configuration, however, contributes to uneven wear of the wiper, since a portion of the wiping surface of the wiper does not contact at least one of the ribs during a cleaning pass.

Therefore, a need exists for improved means for cleaning excess ink and/or contaminants from a printhead wiper.

SUMMARY OF THE INVENTION

The invention is directed to means embodied in an ink jet printhead body for cleaning, guiding and stabilizing a printhead wiper of an ink jet printer.

An ink jet printhead body of the invention includes a receptacle providing an ink reservoir. The receptacle includes a wall, wherein the wall has an outer surface. The wall includes a region at which location of at least one ink discharge nozzle is established. A plurality of ribs is located adjacent the region of the wall. The orientation of the ribs may be defined with reference to a first axis extending in a plane of the outer wall surface and intersecting the wall region in a first direction, and by a second axis, or axis of symmetry, extending in the plane of the outer surface substantially parallel to an edge of the wall and through a central portion of the wall region to perpendicularly intersect the first axis. The orientation of the plurality of ribs is such that a direction of elongation of at least some of the plurality of ribs is in a direction substantially non-orthogonal to both the first axis and the second axis.

In preferred embodiments of the invention, the plurality of ribs defines a plurality of non-rectangular cavities extending below an outer surface of the receptacle, wherein a cavity separates adjacent ribs. The plurality of ribs, for example, may be formed in the wall of the receptacle such that a surface of each of the plurality of ribs is located to be coplanar with an outer surface of the wall, and such ribs may be so formed in each of a first area of the body and a second area of the body, wherein the first and second areas are separated by the region of the wall where the one or more ink discharge nozzles is established.

In preferred embodiments of the invention, the plurality of ribs comprises a first rib and a second rib located to be symmetrical about the axis of symmetry. Also, in more preferred embodiments, the first rib and the second rib form a chevron-like arrangement located to be symmetrical about the axis of symmetry. Such ribs, for example, may be straight or curved. In other embodiments, the plurality of ribs include a pair of substantially chevron shaped, or angular, ribs located to be symmetrical with respect to the axis of symmetry.

In all embodiments of the invention, the plurality of ribs and plurality of cavities form one or more wiper cleaning zones and cooperate to remove and collect excess ink and contaminants from a printhead wiper after the wiper cleans the area surrounding the one or more nozzles in an ink jet printhead cartridge installed in a printing apparatus.

Other features and advantages of the invention may be determined upon consideration of the drawings and the detailed description of the invention that follows.

DESCRIPTION OF PREFERRED EMBODIMENTS

Figure 1:
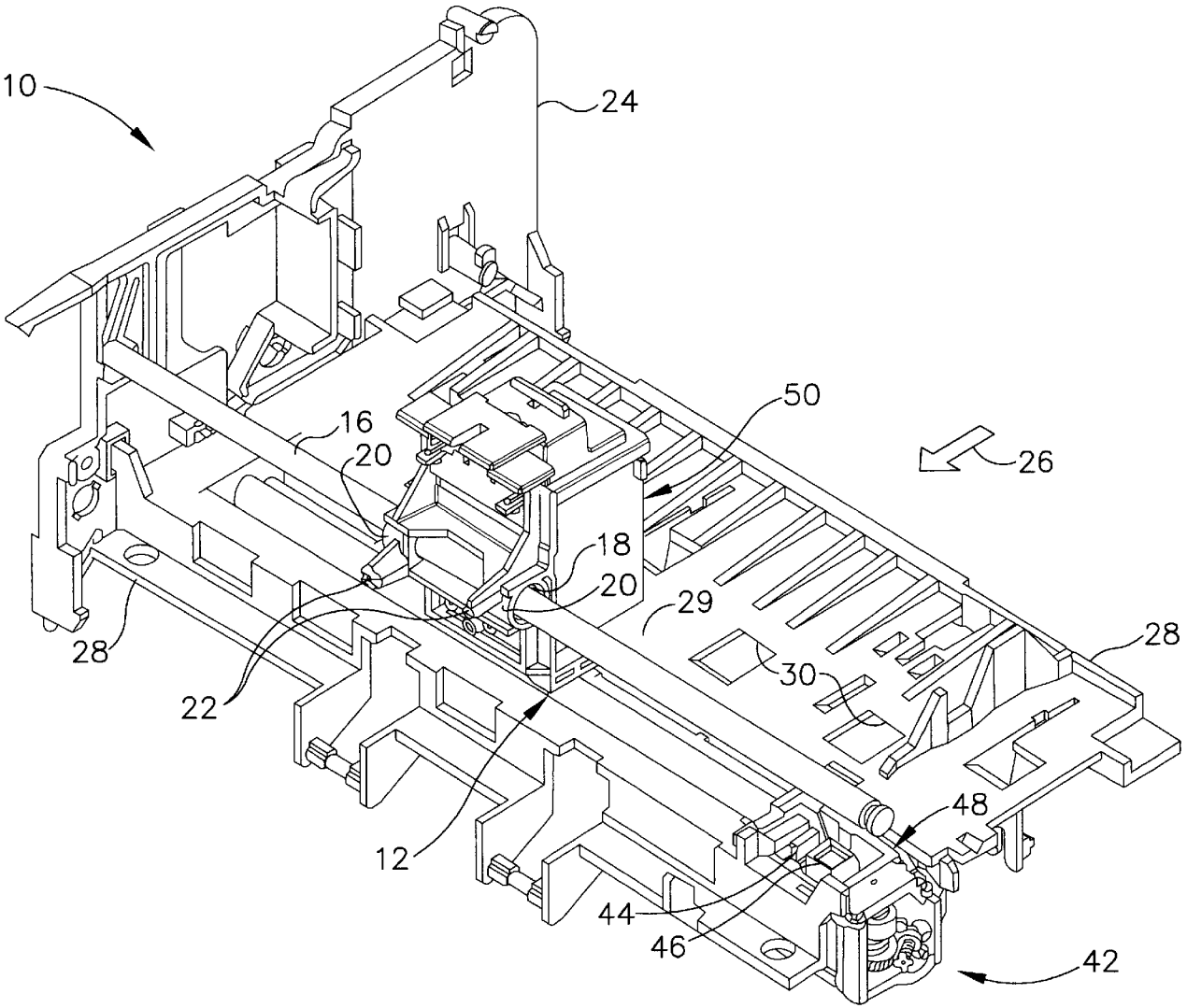
FIG. 1 is a perspective view of a portion of a printer showing an ink jet printhead and a maintenance station, including a wiper for the printhead.

FIG. 1 shows a portion of a printer 10, which includes a printhead carrier assembly 12 which carries a printhead 50 parallel to a guide rod 16. Printer 10 further includes a maintenance, or cleaning, station 42 which includes a wiper 44 for cleaning a region surrounding a plurality of ink jet nozzles 60 (see FIG. 2) of printhead 50.

Printhead 50 is, for example, removable and interchangeable, and may be either a monochrome cartridge having a single ink supply and one or more columns of ink jet nozzles, or a tri-color cartridge having ink supplies of three different colors and including three groups of ink jet nozzles for ejecting the inks.

Figure 2:
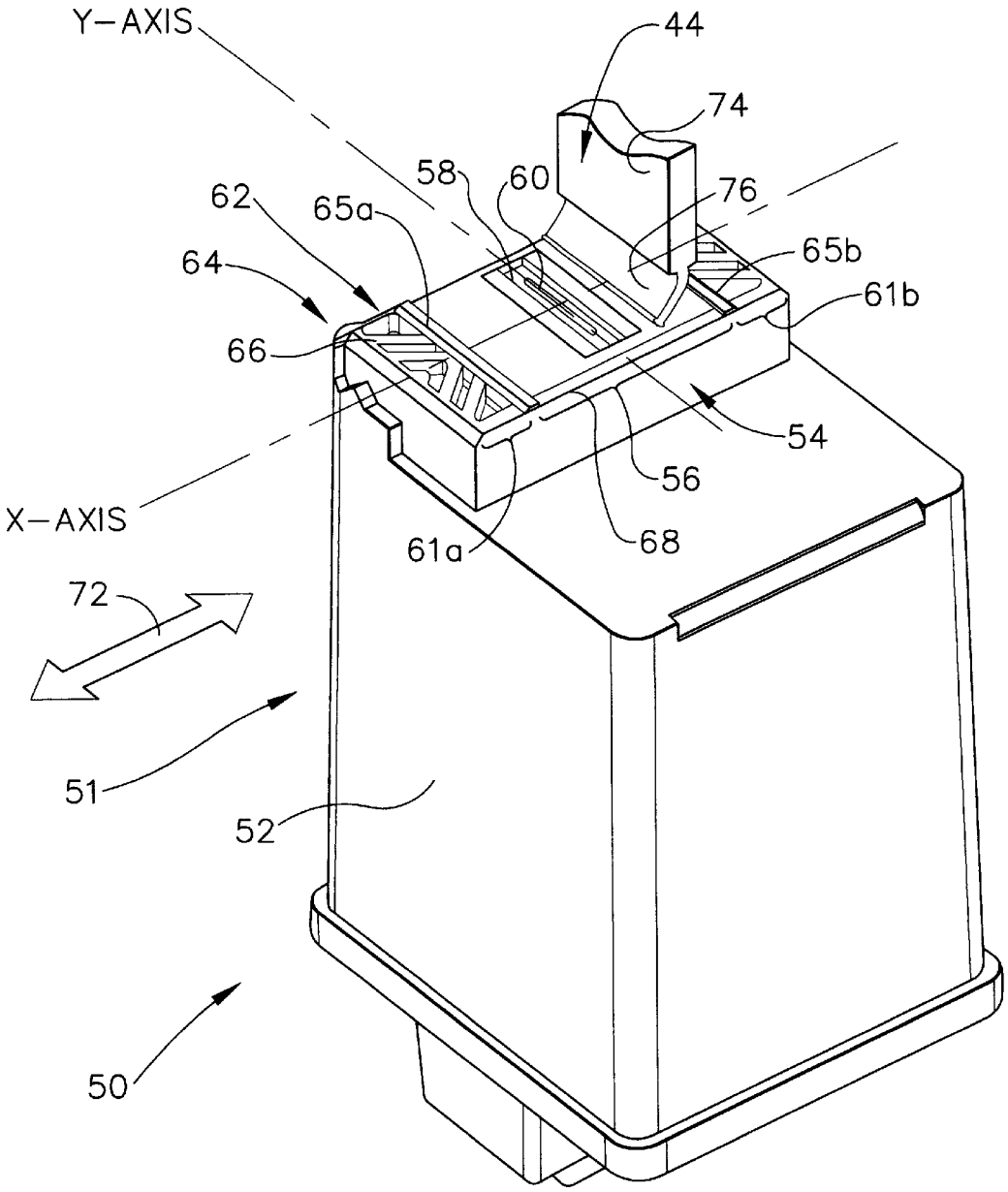
FIG. 2 is perspective view of the printhead of the invention.

As shown in FIG. 2, printhead 50 includes a body 51 which forms a receptacle 52 for providing an ink reservoir having a base wall 54 with a region 56 for mounting a nozzle plate 58 containing ink jet nozzles 60, and further includes controls (not shown) for controlling nozzles 60 to eject ink therefrom. Printhead 50 further includes a pair of wiper cleaning zones 61, identified individually as 61*a* and 61*b*, located adjacent wall region 56. Each of the cleaning zones 61 includes a plurality of ribs 62 and a plurality of cavities 64, wherein at least one cavity is formed between adjacent ribs. As shown in FIG. 2, each of the ribs 62 is substantially straight, although the ribs could be of other shapes, such as angular (chevron-shaped), or curved.

Referring again to FIGS. 1 and 2, wiper 44 of maintenance station 42 is pressed against nozzle plate 58 of printhead 50 during a maintenance operation to clean excess ink and contaminants, such as paper dust, from nozzle plate 58. In turn, ribs 62 and cavities 64 cooperate to remove and collect from wiper 44 the excess ink and contaminants removed from nozzle plate 58.

Elevating members 65*a* and 65*b* are provided immediately adjacent opposing edges of region 56, and between wiper cleaning zones 61 and region 56, and serve to lift wiper 44 from the plane of a surface 66 of ribs 62 of a first cleaning zone, for example cleaning zone 61*a,* to the plane of the outer surface of nozzle plate 58 for wiping and then to gently lower wiper 44 from the plane of the outer surface of nozzle plate 58 to the plane of surface 66 of ribs 62 in a second cleaning zone (cleaning zone 61*b* in this example) after wiping nozzle plate 58.

The outer surface 66 of ribs 62 carry wiper 44 over cavities 64, which prevents wiper 44 from abruptly engaging, or "slapping" the edges of base wall 54 where the cavities begin, thereby reducing the decibel level of the noise generated during a maintenance operation. Also, by avoiding the "slapping" condition, the risk of inadvertently depositing the removed excess ink and contaminants onto the print media is reduced.

More importantly, however, ribs 62 are advantageously sized, oriented and spaced so as to promote even wear of wiper 44 and to guide and stabilize wiper 44 as it traverses wiper cleaning zones 61. In some embodiments of the invention, as more fully described below, the ribs are oriented in a symmetrical fashion to induce a complementary "plowing" effect on wiper 44, to thereby center wiper 44 as it approaches nozzle plate 58. This complementary "plowing" effect can be likened to the effect of wheel tow-in in an automobile steering system in aiding an automoble to travel in a straight line.

Referring again to FIG. 1, carrier assembly 12 is supported on a guide rod 16 by slide bearings 18 housed within two bearing housings 20. Carrier assembly 12 includes two sets of belt gripper jaws 22. Gripper jaws 22, together with a belt (not shown) driven by a bi-directional motor (not shown), comprise a means for moving the carrier assembly and printhead back and forth along guide rod 16.

Guide rod 16 is supported by two side frames 24, only one of which is shown. Guide rod 16 extends transverse to the direction of record feed, indicated by arrow 26, and is located above the record feed path. A molded plastic bed plate or middle frame 28 is mounted between side plates 24 and has an upper surface 29 which defines the lower side of the record feed path. A record sheet is advanced through the printer by feed rolls (not shown) in a conventional manner. Middle frame 28 is provided with a plurality of holes 30 so that feed rolls located below the frame may coact with feed rolls above the frame to feed a record sheet along the top surface of the middle frame and under a guide rail (not shown). As explained in copending Application No. 08/143,328, which is incorporated herein by reference, a guide rail is provided with a groove in which two feet of the carrier assembly 12 ride as the carrier assembly is moved back and forth over the record feed path, and an elongated plastic leaf spring presses a record upwardly against the bottom of the guide rail so that the upper surface of the record is a fixed distance from the nozzle plate 58 as the record passes under nozzles 60, shown in FIG. 2.

Printing takes place in a conventional manner. As a record sheet is fed under printhead 10 in the direction of arrow 26, the printhead carrier assembly is moved back and forth over the record sheet as ink within the printhead is ejected from the nozzles. Data to be printed is received by an Application Specific Integrated Circuit (ASIC) (not shown), which converts or reformats the data and sends electrical signals to the printhead to control ejection of ink from the nozzles.

Maintenance station 42 is provided for cleaning nozzles 60 and capping them, that is, forming an air tight seal around them to prevent ink from drying in them. Maintenance station 42 is suspended from middle frame 28 at one side of, and below, the record feed path. Maintenance station 42 includes wiper 44 and a cup-shaped cap 46. Briefly, wiping comprises raising the wiper 44 until it extends into the path of the printhead surface containing the nozzle plate 58, and moving printhead cartridge 50 past wiper 44 so that wiper 44 is deflected and an edge of wiper 44 wipes the outer surface of the nozzle plate 58 from which the ink is ejected. Accumulated ink and other foreign matter is wiped from the printhead as the printhead moves past the wiper.

Although the present embodiment is described as having a positionable wiper 44, it is contemplated that wiper 44 could be mounted in a fixed position.

In a capping operation the printhead is moved directly over cap 46 and the cap raised into contact with the printhead so as to form an air tight seal around the region in which the nozzles are located.

Further details of the operation of mechanisms for effecting the wiping and capping operations can be found in copending applications 08/143,328 and 08/327,935, which are incorporated herein by reference.

Referring to FIG. 2, wiper element 44 can be, for example, an elastic monolithic body having a mounting portion 74 and a head portion 76. Such a wiper element may be made, for example, from Texin 480-A available from Miles, Inc., or from another material having similar properties of hardness, abrasion resistance, elasticity, and chemical resistance. Texin 480-A is a thermoplastic polyester based polyurethane having a durometer hardness of 85 Shore A. A Taber abrasion test (ASTM method C-501) on this material gives a 20 mg loss in a test run for 1000 cycles using an H-18 wheel with a 1000 gram load.

Figure 3:
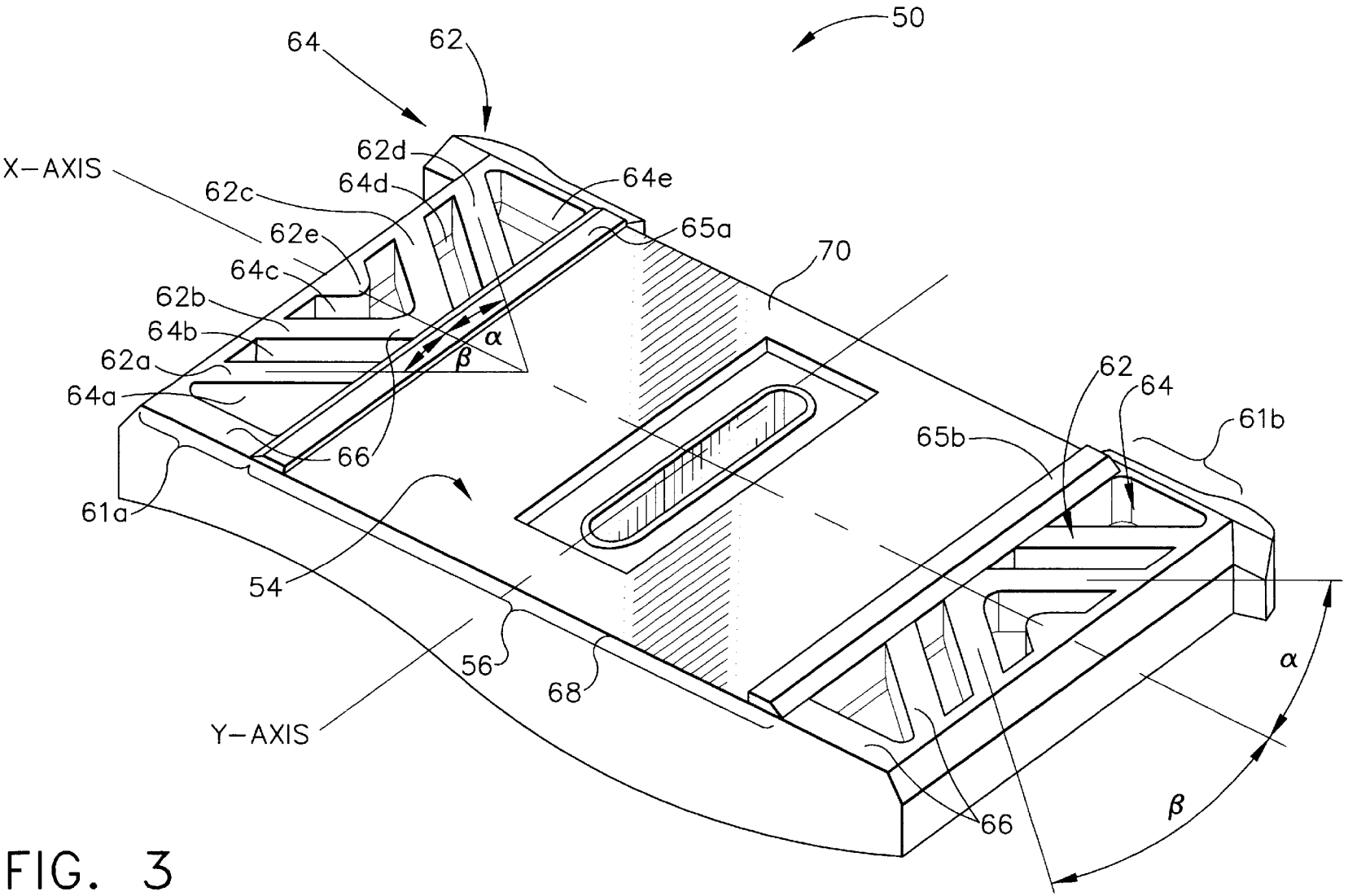
FIG. 3 an enlargement of the nozzle region of the printhead shown in FIG. 2 with the nozzle plate removed therefrom, and showing two wiper cleaning zones.

Referring to FIGS. 2 and 3, in preferred embodiments, as most clearly seen in FIG. 3 wherein nozzle plate 58 has been removed, printhead 50 includes two separate wiper cleaning zones 61*a* and 61*b* which are established adjacent opposing edges of region 56 of wall 54. Thus, the region 56 of wall 54 where the ink jet discharge nozzles 60 are established is located between wiper cleaning zones 61*a* and 61*b,* and wiper cleaning zones 61*a* and 61*b* are symmetrical about region 56.

Although preferred embodiments of the invention are shown and described as having two wiper cleaning zones, it is contemplated that the invention may be practiced using any number of cleaning zones, including a single wiper cleaning zone.

Referring to FIG. 3, the orientation of the ribs 62 of wiper cleaning zones 61 is best defined with reference to a first axis, or Y axis, extending in the plane of an outer surface 70 of wall 54 and intersecting the region 56 of wall 54, and by a second axis, or X-axis, forming an axis of symmetry in the plane of outer surface 70 and extending substantially parallel to an edge 68 of wall 54 and through a central portion of region 56 to perpendicularly intersect the Y-axis. With reference to these axises, the plurality of ribs 62 are located adjacent region 56 of wall 54 in cleaning zones 61 such that a direction of elongation of at least one of the plurality of ribs is in a direction substantially non-orthagonal to both the X-axis (axis of symmetry) and the Y-axis. Ribs 62, preferably formed in or on wall 54 of printhead body 51, define the plurality of non-rectangularly shaped cavities 64 which extend below surface 66 of ribs 62. Preferably, ribs 62 are formed in wall 54 such that surface 66 of each of plurality of ribs is coplanar with surface 70 of wall 54.

Ribs 62 are preferably formed in wall 54 by removing material from wall 54 to form cavities 64. Alternatively, ribs 62 and cavities 64 may be formed during the molding of printhead body 51.

In preferred embodiments of the invention, the plurality of ribs 62 comprises ribs which are located to be symmetrical about the axis of symmetry. And, as shown in FIGS. 2 and 3, a preferred orientation of the ribs are to form chevron-like arrangements of ribs. For example, and with reference to FIG. 3, ribs 62*a* and 62*d* form a first symmetrical chevron-like arrangement, and ribs 62*b* and 62*c* form a second chevron-like arrangement. The chevron-like arrangements are located to be symmetrical about the axis of symmetry (X-axis), which passes through a central portion of region 56, such that angle  is substantially equal to angle β. Also, rib 62*e* has a triangular-like shape and is centered to be symmetrical about the axis of symmetry. As shown in FIG. 2 the orientation of the wiper 44 and the ribs 62 are such that the axis of symmetry is substantially parallel to a direction of wiping, wherein the direction of wiping may be bidirectional, as indicated by the double headed arrow 72.

Preferably, angle  and angle β are each in the range of about 5° to about 85°. As angle  and angle β decreases toward the lower portion of this range, however, it is necessary to adjust the spacing between the ribs so that the entire cleaning surface of printhead wiper 44 contacts the cumulative outer surface 66 of at least a portion of the ribs 62, so that no portion of the cleaning surface of wiper 44 is missed in a single cleaning pass. To maximize the length of the ribs 62 and the spacing of ribs 62, and still perform the desired cleaning of the cleaning surface of wiper 44, angles  and β are preferrably in a range of about 30° to about 60°.

Figure 4:
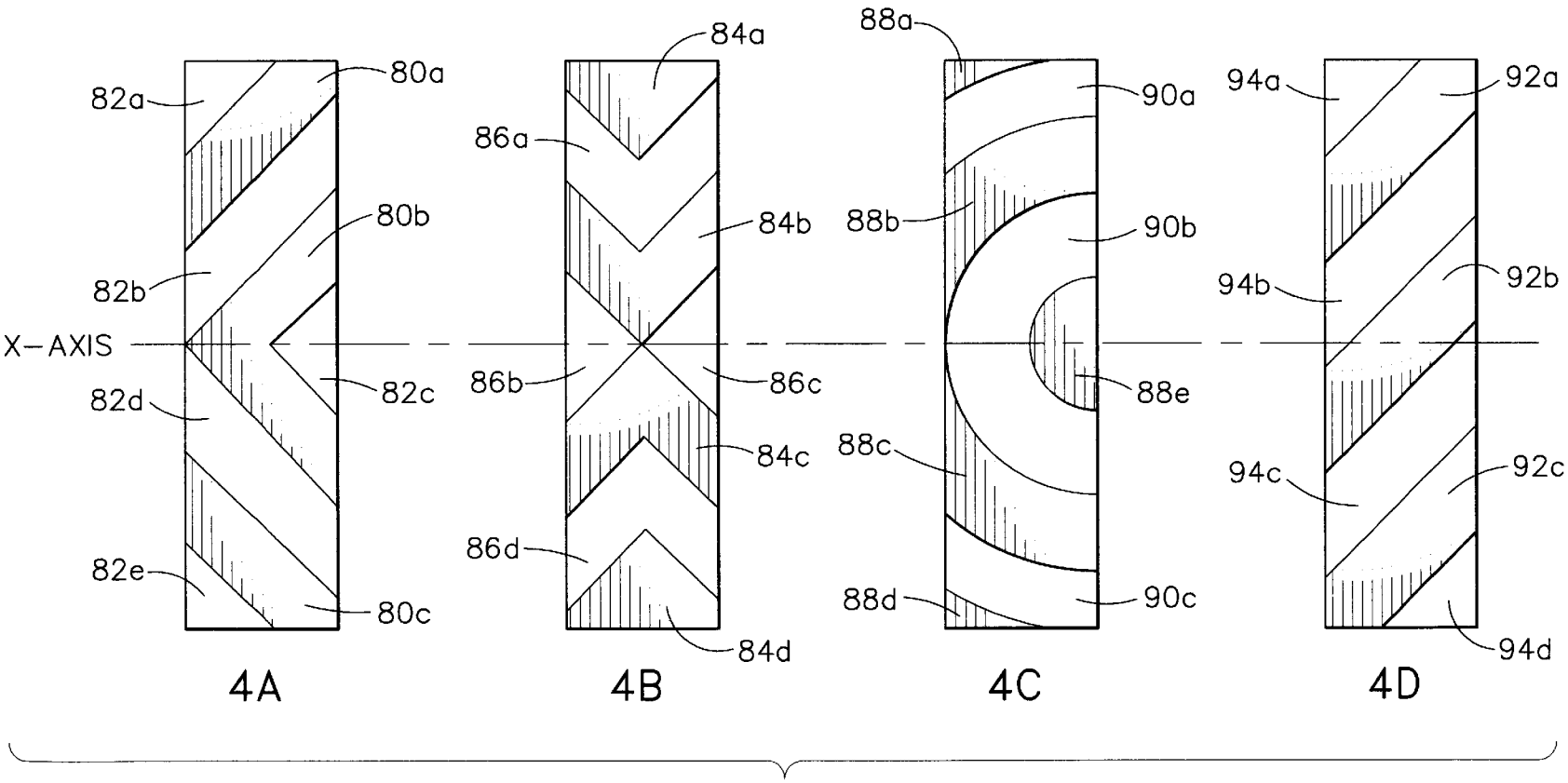
FIG. 4 consisting of FIGS. 4A–4D, shows plan views of alternative rib and cavity orientations for a wiper cleaning zone.

FIGS. 4A, 4B and 4C show alternative symmetrical rib orientations for a cleaning zone 61 of the invention. FIG. 4A shows an orientation of ribs 80*a*–80*c* and cavities 82*a*–82*e* which essentially form an inversion of the placement of the ribs 62 and cavities 64 shown in FIGS. 2 and 3. FIG. 4B shows a configuration of ribs 84*a*–84*d* and cavities 86*a*–86*d,* wherein ribs 84*a*–84*d* form a first pair of chevron-shaped ribs 84*a,* 84*d* and a second pair of chevron-shaped ribs 84*b,* 84*c* which are located to be symmetrical with respect to the axis of symmetry (X-axis). FIG. 4C shows a symmetrical arrangement of ribs 88*a*–88*e* and cavities 90*a*–90*c,* wherein the ribs have a curved shape.

FIG. 4D shows another alternative orientation of ribs, in which ribs 92*a*–92*c* and cavities 94*a*–94*d* are angularly disposed across the cleaning zone, but in which the ribs are not symmetrical with respect to the X-axis.

As was the case with ribs 62 shown in FIG. 2, the ribs 80, 84, 88 and 92 of FIGS. 4A–4D, respectively, are located and spaced such that the entire cleaning surface of wiper 44 comes in contact with at least a portion of the ribs during a single cleaning pass. The orientation of the plurality of ribs effectively guide the wiper blade as wiper 44 traverses cleaning zone 61, and in symmetrical arrangements of ribs as shown in FIGS. 2, 3 and 4A–4C, the ribs guide wiper 44 in a direction parallel to the axis of symmetry (X-axis).

Although the present invention has been described with reference to preferred embodiments, workers skilled in the art will recognize the changes may be made in form and detail without departing from the spirit and scope of the following claims.

What is claimed is:

1. An ink jet printhead body for use with an external wiping apparatus, comprising:

a receptacle providing an ink reservoir, wherein said reservoir includes a wall, said wall having an outer surface and having a region at which location of at least one ink discharge nozzle is established; and a plurality of ribs located adjacent said region of said wall, wherein an orientation of said ribs, as defined with reference to a first axis extending in a plane of said outer surface and intersecting said region of said wall in a first direction and by a second axis extending in said plane of said outer surface and extending substantially parallel to an edge of said wall and through a central portion of said region to perpendicularly intersect said first axis, is such that a direction of elongation of at least one of said plurality of ribs is in a direction non-orthogonal to both said first axis and said second axis, and wherein said orientation of said ribs comprises a structure that is symmetrical about said second axis, and provides a contact surface having a tendency to direct said external wiping apparatus, as said external wiping apparatus comes into contact against said contact surface, toward a centerline along said second axis.

2. The ink jet printhead body of claim 1, wherein said plurality of ribs defines a plurality of non-rectangular cavities extending below an outer surface of said receptacle and located adjacent said region of said wall.

3. The ink jet printhead body of claim 1, wherein said plurality of ribs is formed in said wall of said receptacle such that a surface of each of said plurality of ribs is located in a coplanar relationship with an outer surface of said wall.

4. The ink jet printhead body of claim 1, wherein said plurality of ribs are formed in each of a first area of said body and a second area of said body, wherein said first and second areas are separated by said region of said wall where said at least one ink discharge nozzle is established.

5. The ink jet printhead body of claim 1, wherein said plurality of ribs comprises a pair of ribs formed in a chevron-like arrangement.

6. The ink jet printhead body of claim 1, wherein at least one of said plurality of ribs is of a curved shape.

7. A printing apparatus having an ink jet printhead cartridge comprising:

a plurality of ink discharge nozzles for controllably dispensing ink;

a wiper for cleaning a region surrounding said plurality of ink discharge nozzles; and a printhead body defining an ink reservoir having a wall with a region where said plurality of ink discharge nozzles is established, and having a wiper cleaning zone including a plurality of ribs located adjacent said region of said wall and located to define a plurality of cavities in said body, wherein an orientation of at least two of said plurality of ribs comprises a structure that is symmetrical about an axis parallel to a direction of wiping, and wherein said plurality of ribs and said plurality of cavities cooperate to remove contaminants from said wiper and cooperate to induce a plowing effect that tends to center the wiper's travel while in contact with said plurality of ribs, said plurality of ribs providing to said wiper a substantially continuous surface so as to substantially prevent slapping of said wiper against said ribs.

8. The apparatus of claim 7, wherein said plurality of ribs comprises a pair of ribs positioned in a chevron-like arrangement.

9. The apparatus of claim 7, wherein said plurality of ribs is formed in said wall of said body such that a surface of each of said plurality of ribs is located to be coplanar with an outer surface of said wall.

10. The apparatus of claim 7, wherein at least one of said plurality of ribs is curved.

11. An ink jet printhead cartridge having a cleaning region for cleaning a wiper in a printing system, said cartridge comprising:

a plurality of ink discharge nozzles for controllably dispensing ink; and a printhead body including a receptacle providing an ink reservoir, and having a wall with said cleaning region where said plurality of ink discharge nozzles is located, wherein said printhead body is further defined with reference to a first axis extending in a plane of an outer surface of said printhead body and intersecting said cleaning region from a first direction, and an axis of symmetry extending in said plane of said outer surface and extending through a central portion of said cleaning region and perpendicularly intersecting said first axis, wherein a plurality of ribs are formed in said printhead adjacent said cleaning region of said wall, wherein an orientation of at least one pair of said plurality of ribs comprises a structure that is symmetrical about said axis of symmetry, and wherein contaminants are removed from said wiper by way of contact against said plurality of ribs as said wiper moves with respect to said ribs, and wherein said plurality of ribs cooperates to induce a plowing effect that tends to center the wiper's travel while in contact with said plurality of ribs, and wherein said wiper exhibits substantially even wear due to contact with said plurality of ribs.

12. The ink jet cartridge of claim 11, wherein said plurality of ribs defines a plurality of non-rectangular cavities extending below said outer surface of said printhead body and located adjacent said region of said wall.

13. The apparatus of claim 11, wherein said plurality of ribs comprises a pair of ribs formed in a chevron-like arrangement.

14. An ink jet printhead body having an outer surface and having a wall with a region at which location of an ink discharge nozzle is established, comprising a plurality of ribs arranged to form at least one chevron-like arrangement of ribs located adjacent said region of said wall, said plurality of ribs being configured to provide to a contacting external wiper a substantially continuous surface so as to substantially prevent slapping of said wiper against said ribs, and being further configured to cause said wiper to wear substantially evenly due to contact with said plurality of ribs.

15. The ink jet printhead body of claim 14, wherein at least one chevron-like arrangement of ribs is located in each of a first area and a second area of said body, wherein said first and second areas of said body are separated by said region of said wall where said ink discharge nozzle is established.

16. An ink jet printhead body for use with a external wiping apparatus, comprising:

a receptacle providing an ink reservoir, wherein said reservoir includes a wall, said wall having an outer surface and having a region at which location of at least one ink discharge nozzle is established; and a plurality of ribs located adjacent said region of said wall, wherein an orientation of said ribs, as defined with reference to a first axis extending in a plane of said outer surface and intersecting said region of said wall in a first direction and by a second axis extending in said plane of said outer surface and extending substantially parallel to an edge of said wall and through a central portion of said region to perpendicularly intersect said first axis, is such that a direction of elongation of at least one of said plurality of ribs is in a direction non-orthogonal to both said first axis and said second axis, and wherein said plurality of ribs comprises at least one pair of ribs formed in a chevron-like arrangement, and provides a contact surface having a tendency to direct said external wiping apparatus, as said external wiping apparatus comes into contact against said contact surface, toward a centerline along said second axis.

17. The ink jet printhead body of claim 16, wherein said chevron-like arrangement of ribs is located to be symmetrical about said second axis.

18. A printing apparatus having an ink jet printhead cartridge comprising:

a plurality of ink discharge nozzles for controllably dispensing ink;

a wiper for cleaning a region surrounding said plurality of ink discharge nozzles; and a printhead body defining an ink reservoir having a wall with a region where said plurality of ink discharge nozzles is established, and having a wiper cleaning zone including a plurality of ribs located adjacent said region of said wall and located to define a plurality of cavities in said body, wherein an orientation of at least two of said plurality of ribs forms a chevron-like arrangement, and wherein said plurality of ribs and said plurality of cavities cooperate to remove contaminants from said wiper and cooperate to induce a plowing effect that tends to center the wiper's travel while in contact with said plurality of ribs, said plurality of ribs providing to said wiper a substantially continuous surface so as to substantially prevent slapping of said wiper against said ribs.

19. The apparatus of claim 18, wherein said plurality of ribs comprises a first rib and a second rib located in a symmetrical relationship about an axis of symmetry, which is substantially parallel to said direction of wiping.

20. An ink jet printhead cartridge having a cleaning region for cleaning a wiper in a printing system, said cartridge comprising:

a plurality of ink discharge nozzles for controllably dispensing ink; and a printhead body including a receptacle providing an ink reservoir, and having a wall with said cleaning region where said plurality of ink discharge nozzles is located, wherein said printhead body is further defined with reference to a first axis extending in a plane of an outer surface of said printhead body and intersecting said cleaning region from a first direction, and an axis of symmetry extending in said plane of said outer surface and extending through a central portion of said cleaning region and perpendicularly intersecting said first axis, wherein a plurality of ribs are formed in said printhead adjacent said cleaning region of said wall, wherein at least one pair of said plurality of ribs is formed in a chevron-like arrangement, and wherein contaminants are removed from said wiper by way of contact against said plurality of ribs as said wiper moves with respect to said ribs, and wherein said plurality of ribs cooperates to induce a plowing effect that tends to center the wiper's travel while in contact with said plurality of ribs, and wherein said wiper exhibits substantially even wear due to contact with said plurality of ribs.

21. The ink jet printhead cartridge of claim 20, wherein said plurality of ribs comprises a first rib and a second rib located in a symmetrical relationship about said axis of symmetry.

* * * * *